US008562246B2

(12) United States Patent
Utterodt et al.

(10) Patent No.: US 8,562,246 B2
(45) Date of Patent: Oct. 22, 2013

(54) PROCESS FOR PRODUCING A ROAD COVERING, FEEDER, ROAD PAVER AND PAVING TRAIN

(75) Inventors: Ronald Utterodt, Lutten (DE); Marcus Utterodt, Lutten (DE); Klaus-Dieter Bunk, Ahlhorn (DE)

(73) Assignee: Dynapac GmbH, Wardenburg (DE)

( * ) Notice: Subject to any disclaimer, the term of this patent is extended or adjusted under 35 U.S.C. 154(b) by 0 days.

(21) Appl. No.: 12/964,095

(22) Filed: Dec. 9, 2010

(65) Prior Publication Data

US 2011/0318102 A1 Dec. 29, 2011

(30) Foreign Application Priority Data

Jun. 25, 2010 (DE) ..... 10 2010 025 129
Nov. 8, 2010 (DE) ..... 10 2010 050 490

(51) Int. Cl.
*E01C 23/14* (2006.01)

(52) U.S. Cl.
USPC ..... 404/79

(58) Field of Classification Search
USPC ..... 404/72, 79, 95
See application file for complete search history.

(56) References Cited

U.S. PATENT DOCUMENTS

| | | | | | |
|---|---|---|---|---|---|
| 4,175,885 | A * | 11/1979 | Jeppson | 404/77 |
| 4,347,016 | A * | 8/1982 | Sindelar et al. | 404/95 |
| 4,812,076 | A * | 3/1989 | Yant | 404/108 |
| 5,291,876 | A * | 3/1994 | Milstead | 126/343.5 A |
| 5,333,969 | A * | 8/1994 | Blaha et al. | 404/91 |
| 6,109,826 | A * | 8/2000 | Mertes | 404/95 |
| 6,939,079 | B2 * | 9/2005 | Lloyd | 404/91 |
| 7,448,825 | B2 * | 11/2008 | Kasahara et al. | 404/80 |

* cited by examiner

*Primary Examiner* — Gary Hartmann
(74) *Attorney, Agent, or Firm* — Laurence P. Colton; Smith Risley Tempel Santos LLC

(57) ABSTRACT

A process for producing an asphalt layer in which material with properties that deviate from predetermined requirements is specifically homogenized, and a paving train (10), a road paver (12) and a feeder (14) for carrying out the process.

14 Claims, 8 Drawing Sheets

PROCESS FOR PRODUCING A ROAD COVERING, FEEDER, ROAD PAVER AND PAVING TRAIN

STATEMENT OF RELATED APPLICATIONS

This application claims priority on and the benefit of German Patent Application No. 10 2010 025 129.1 having a filing date of 25 Jun. 2010 and German Patent Application No. 10 2010 050 490.4 having a filing date of 8 Nov. 2010, both of which are incorporated herein in their entireties by this reference.

BACKGROUND OF THE INVENTION

1. Technical Field

The invention relates to a process for producing a road covering of asphalt, in particular an asphalt surface or an asphalt road, with a road paver, with material for producing the road covering being supplied to the road paver and said material being homogenized. The invention additionally relates to a road paver, with an undercarriage, with at least one hopper, in particular at least one chamber for holding preferably at least essentially continuously supplied material, with a screed for producing a road covering, and with a conveyor for conveying material to the screed, and with a device for homogenizing the material. The invention also relates to a feeder, with an undercarriage, with at least one hopper for holding material, with a conveyor for preferably continuously supplying material from the hopper to a road paver for laying a road covering, in particular an asphalt layer or asphalt covering. The invention moreover relates to a paving train with at least one road paver, and with at least one feeder, it being possible to produce at least one road covering by the road paver, and for material for producing the surface covering to be supplied by the feeder to the road paver, preferably continuously.

2. Prior Art

Surface coverings or road structures, which can, for example, be walked or driven over, such as in particular road surfacing or road surface layers and in particular roadway pavings, are usually produced from materials such as, preferably, asphalt. So-called road pavers are generally used to produce the layer of material that is applied on top of a subsurface.

The material is usually at least essentially continuously supplied to the road paver in order to ensure an even application of material that is as uninterrupted as possible. As a buffer for short interruptions in delivery, the road paver generally has a container or hopper that is also known as a material bunker. The material is usually loaded into this hopper from a so-called feeder with the aid of a conveyor. The road paver itself usually also has a conveyor, preferably a scraper conveyor, which serves to remove material from the hopper and supply it to a screed. The screed distributes and compacts the material evenly on the subsurface. The road paver can be designed as a single-layer or multi-layer paver.

Surface coverings made from rolled asphalt are laid when they are hot. In order to ensure optimum durability of the surface covering produced, it is necessary, on the one hand, to prevent properties of the material from deviating from specifications, such as an optimum working temperature, and differences in the temperature or composition. Mixing devices are usually used for this purpose, which mix a portion of the material to provide it with uniform properties, in particular a uniform temperature, i.e. the material is homogenized before it is laid with the paver. The continuous mixing of the road-surface material entails a high level of energy consumption and causes considerable wear on the required mixing devices.

BRIEF SUMMARY OF THE INVENTION

The object of the invention is to create a process that enables an optimal quality of the road surface material while preventing high energy consumption and wear.

A process that fulfils this object is a process for producing a road covering of asphalt, in particular an asphalt surface or an asphalt road, with a road paver, with material for producing the road covering being supplied to the road paver and said material being homogenized, characterized in that specifically only such material is used for the homogenizing that deviates in at least one property from predetermined requirements. It is accordingly provided specifically to homogenize such, and preferably only such, material or road-surface material where its properties deviate from predetermined requirements or which does not have the required properties. The material to be homogenized preferably has at least one property that deviates from predetermined requirements. These can, for example, be different physical properties of the material. Meeting predetermined requirements is necessary to achieve optimum quality and durability of the asphalt road.

The material to be homogenized is preferably separated from the other material at least temporally. This means that the material or at least part of the material which deviates or deviates excessively from the corresponding properties is handled separately. It is thus ensured that the other material has at least essentially the required properties. In particular, the separated part of the material is stored apart from the other material. The material is preferably supplied to a hopper of the road paver and/or the feeder. The separated material is more preferably also supplied to a hopper of the road paver and/or the feeder. This is in particular a preferably separate hopper or an in particular separate section or area or preferably a separate chamber of the hopper. The material to be homogenized is added to the other material preferably in a metered fashion. The material to be homogenized is thus preferably deposited on the other material, in particular in layers or in a layer. The material is usually transported with the aid of a conveyor such as a conveyor belt or scraper conveyor, with the aid of which it is transported in particular as an at least essentially layer-forming stream of material. The separated material is therefore preferably deposited on this stream of material or in the region of the conveyor, or is supplied or added to it. An at least almost even spreading or mixing can thus be achieved. Homogenization thus results.

The material and/or the separated material is more preferably thoroughly mixed. The material and/or the separated material preferably passes through a mixing device to homogenize the material. At least one conveyor such as, for example, a conveying or mixing auger is provided for the thorough mixing. Alternatively, the material or the separated material can bypass the mixing device.

Provided for the homogenization of the material is in particular a preferably separate container which is filled with the material to be homogenized. An essentially cylindrical configuration of the container is particularly preferred, especially one having a conically tapering lower end. In order to minimize any heat losses, the container or cylinder is preferably equipped with at least one insulating wall for heat insulation. Positioned in the interior of the container is a mixing device, in particular a rotatably mounted and preferably centrally disposed axis or revolving axis with a plurality of in particular convex and/or concave blades. The blades in this case extend essentially from the central axis to a point near the inner wall of the container. A very preferred arrangement is one with alternating convex and concave blades disposed about the axis, preferably in a plurality of planes. When the mixing device revolves about its axis, the mixture introduced into the container is blended and thus brought to an essentially uniform temperature during the mixing process. Arranged at the lower, conically tapering end region of the container is preferably a removal device. To this end, a slide can be provided, for example, with which a desired quantity of the mix can be released from the container onto the conveyor arranged below, in particular in a continuous manner. The mixing process is preferably executed such that the mixing device, due to the varying concave and convex blade elements, which are preferably arranged in alternating fashion, forces the mix downward during the mixing process along a path which leads from the top end of the cylinder to the lower end and which directs the mix alternately inwards toward the central axis and outwards toward the container wall. In order to raise the temperature of the mixture as a whole a heating element can be additionally provided, for example in the region of the mixing device, such as in the vicinity of the blade elements or the central axis or even the container wall. The heating element can, for example, be powered by electrical means or by a gas heater, for example.

The temperature of the material is preferably regarded as a relevant value, in particular the average temperature. The material is preferably used for homogenizing depending on its temperature. Material is homogenized that at least in sections has a temperature that deviates from a reference temperature and/or that deviates from the temperature of the other material. The reference temperature or the size of the deviation from the temperature of the other material, in particular its average temperature, can be predetermined for this. A negative deviation preferably results in the separation of at least part of the material, as material temperatures that are too low can cause a reduction in the quality of the material. The material or its properties such as the temperature of the material are preferably homogenized, entailing a selective distributing or thorough mixing. This is achieved by in particular colder material being supplied again to the other material in a preferably metered fashion. However, this happens in such small amounts, or is distributed in such a way that no significant or excessive cooling of the other material is caused by the supplied material. By means of metered addition, relatively small amounts of separated and in particular colder material can thus be supplied to the other material or the stream of material for a homogenization of the temperature. In particular, the temperature of the separated material at least almost matches the temperature of the other material. A homogenization of the temperature is thus all in all achieved.

Corresponding threshold values or fixed reference temperatures are provided in order to split off or separate part of the material. Part of the material is preferably separated if the temperature of the material falls below a reference temperature. It can additionally or alternatively be provided that the temperature deviation relative to the other material, i.e. for example an average temperature of the material, is at least 5 K, preferably at least 10 K and particularly preferably at least 14 K. (Absolute temperatures are measured in degrees Celsuis, while temperature differences are measured in Kelvin herein.) This means that these deviations are present, on the one hand, relative to the reference temperature and, on the other hand, relative to the temperature of the other material. It has been shown that a deviation of more than 14 K, in particular in the form of colder areas of the material, so-called "nests", results in a marked deterioration in the quality of the surface covering.

The temperature of the material is preferably measured by means of a measuring apparatus. The temperature is preferably measured on the road paver and/or on the feeder. The measurement more preferably takes place in the region of a conveyor and/or a hopper for the material. In particular, at least one sensor arrangement is provided with at least one sensor. An infrared sensor is preferably used as a sensor that preferably works in a non-contact fashion. The temperature of the material by sections in individual areas can thus be determined preferably by multiple sensors, preferably arranged at least essentially adjacent to one another, at a suitable distance from the material or stream of material streaming past, in particular on a conveyor. Depending on the temperature, preferably determined at different places, corresponding areas or parts of the material or stream of material can be separated by suitable means. The temperature is preferably measured as averages over flat areas of the material. This is due to the fact that each sensor monitors a specific surface area of the material. Furthermore, the creation of so-called "nests" with too low temperatures and a certain minimum size results in a marked deterioration in the quality of the road covering. The cross section or diameter of these areas is usually at least approximately 5 cm to 10 cm or even 20 cm, but sometimes can even be several decimeters. Substantially smaller nests are normally unproblematic and can accordingly be disregarded. The measuring equipment thus needs to be adapted so that correspondingly small areas are taken into consideration or ignored during the measuring. An imaging process can preferably be provided for determining the temperature distribution of the material, in particular an infrared camera with corresponding analysis.

A screed is in particular provided on the road paver, serving to apply the supplied material to a subsurface and there compact it. Moreover, a conveying means, in particular a conveying auger or distributing auger, can distribute the material at least essentially evenly over the width of the screed. A conveyor is more preferably provided which supplies the material from a storage means, in particular one of the hoppers or chambers of the screed. Alternatively, the conveyor can, for example, also be loaded directly from the feeder, in order to transport the material to the screed.

A road paver which fulfils the object of the invention mentioned at the beginning is a road paver, with an undercarriage, with at least one hopper, in particular at least one chamber for holding preferably at least essentially continuously supplied material, with a screed for producing a road covering, and with a conveyor for conveying material to the screed, and with a device for homogenizing the material, characterized in that at least one separate hopper and/or at least one separate chamber is provided for holding material for homogenizing with at least one property that deviates from predetermined requirements. Accordingly, a separate hopper is provided for holding material for homogenizing which has at least one property that deviates from predetermined requirements and/or does not have the required properties.

The feeder which fulfils the object of the invention mentioned at the beginning is a feeder, with an undercarriage, with at least one hopper for holding material, with a conveyor for preferably continuously supplying material from the hopper to a road paver for laying a road covering, in particular an asphalt layer or asphalt covering, characterized in that at least one measuring apparatus is provided for determining at least one property of the material. Accordingly, a measuring apparatus is provided in order to determine at least one property of the material.

A paving train which fulfils the object of the invention mentioned at the beginning is a paving train with at least one road paver, in particular according to the invention, and with at least one feeder, in particular according to the invention, it being possible to produce at least one road covering by the road paver, and for material for producing the surface covering to be supplied by the feeder to the road paver, preferably continuously, characterized in that a measuring apparatus is provided for determining at least one property of the material, and/or an additional hopper for holding material for homogenizing. Accordingly, a measuring apparatus for determining at least one property of the material is provided.

The following detailed embodiments or developments of the invention each relate by analogy to the road paver as well as to the feeder and the paving train.

The material which has at least one property that deviates from predetermined requirements or does not have the required properties can preferably be specifically homogenized. This means, in particular, that part of the material is split off or can be split off from the other material. Material with deviating properties is thus singled out, as otherwise the quality of the asphalt layer or asphalt overlay produced would be reduced.

At least part of the material with a temperature that deviates from a reference temperature and/or from that of the other material can, more preferably, be separated off. A separating device for splitting off or separating material is preferably provided. The separating device preferably separates material depending on its temperature. In particular, at least one preferably at least partially pivotable element or guide member is provided which serves to separate the material. This element is, in particular, designed as a guide plate, preferably as a pivotable conveyor. The stream of material can thus be directed in different directions or to different places. Accordingly, the material to be homogenized or to be separated can, for example, be directed into a separate hopper or a separate chamber of a hopper.

A hopper is preferably provided on the road paver or on the feeder for at least temporarily holding in particular the separated material or material to be homogenized, or the material for homogenizing. The material to be homogenized is preferably supplied to the other material in metered fashion and/or as a layer. The material to be homogenized can thus preferably be removed from the corresponding receptacle, in particular from the separate receptacle, in particular from one of the chambers. The hopper has at least one separate chamber, and preferably two chambers.

A conveyor such as, for example, a conveying auger or a conveyor belt or a scraper conveyor is in particular provided for the removal of material from the hopper or from the chamber. At least one conveyor, in particular a conveying auger, is more preferably provided to convey and/or mix the material and/or the separated material. The conveyor or conveyors can thus fulfill both functions jointly or separately. The conveyors can be arranged parallel and/or antiparallel to each other but can also be arranged at any angle to each other, although preferably at least almost at right angles to each other.

In the case of conveying augers, the material is preferably arranged above in a hopper or in one of the chambers. It is transported away or mixed in an essentially horizontal plane. The conveyors particularly preferably serve to add the separated part of the material to the other part of the material, in particular in a metered fashion. This ensures an even distribution of the separated parts of the material. In this way the temperature is matched to the average temperature of the other material. The separated material is particularly preferably added in layers and/or in small amounts to the other material or mixed with it. This ensures optimum heating of the added material, while the other material is only minimally cooled.

In particular, at least one measuring apparatus is provided for the in particular continuous measurement, at least in sections, of a temperature of the material and/or of the separated material. At least one sensor arrangement is more preferably provided as a measuring apparatus. The sensor arrangement has at least one sensor that works, in particular, in a non-contact fashion. The sensor is preferably an infrared sensor. Three sensors or measuring apparatus are preferably used, which are arranged in particular at least essentially linear and/or in or transverse to the conveying direction. Particularly when assuming a transverse arrangement, the measuring apparatus are distributed over the cross section of the conveyor, preferably evenly. An imaging sensor such as, for example, an infrared camera can also particularly preferably be used. It is thus possible to establish the temperature distributions and local temperature differences or maximum and minimum temperature values in the material or in the stream of material. The temperature of the material is preferably determined in the region of the conveyor. This has the consequence that, when the material is moved continuously through the conveyor and with an essentially fixedly mounted sensor, snapshots of the temperature distribution of the material at the respective point in time can be taken in a corresponding section of the material. Alternatively, the measuring apparatus can be arranged so as to be movable or pivotable. The measuring apparatus is, in particular, provided on the feeder but can also be associated, for example, with the road paver and/or with a separate vehicle having a homogenization device, or with the homogenizer.

The material can also more preferably be homogenized by a separate device for homogenizing, in particular a preferably self-propelled homogenizer. The device or the homogenizer is, to this end, associated in particular with at least one conveyor and/or at least one hopper. The material can also more preferably be brought together and/or mixed for the homogenizing. The material is preferably supplied to the road paver by a self-propelled feeder. The feeder has for this purpose in particular a conveyor, such as a conveyor belt, a scraper conveyor or the like. The material is supplied to the feeder, for example into a hopper arranged thereon or to a chamber. The conveyor transports the material from the hopper to the region of the road paver. The road paver and the feeder are constituents of the so-called paving train.

A conveyor belt, a scraper conveyor or the like preferably serves as a conveyor. Particularly preferably, the temperature or the temperature distribution is or can be determined at least in sections on the road paver and/or on the feeder and/or on a homogenizer. The road paver can be designed as a single-layer or multi-layer paver. A multi-layer paver can apply several layers of asphalt to a subsurface in a single operation.

BRIEF DESCRIPTION OF THE DRAWINGS

Preferred embodiments of the invention are described in more detail below with reference to the drawings, in which.

DETAILED DESCRIPTION OF PREFERRED EMBODIMENTS

Figure 1:
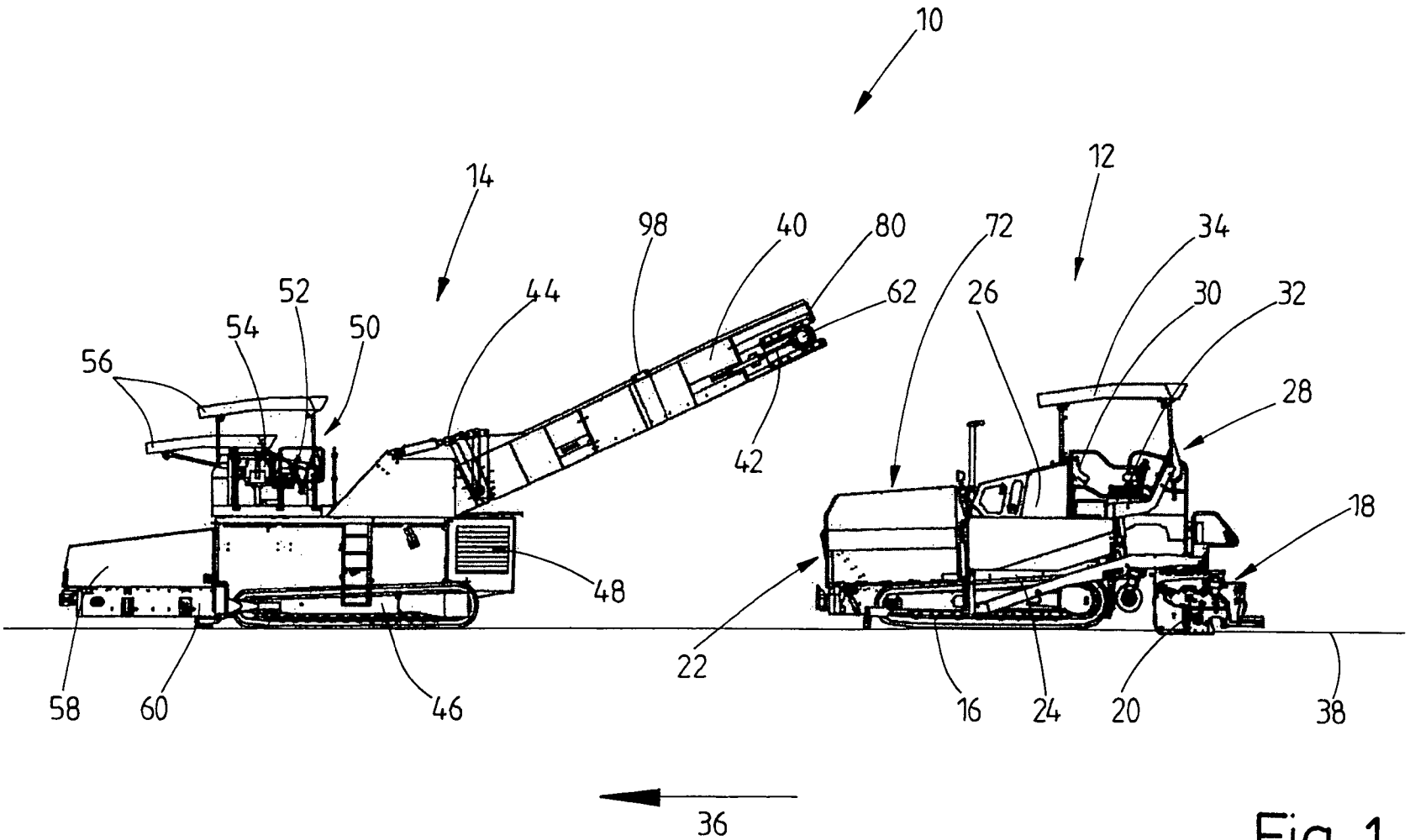
FIG. 1 shows a paving train with a road paver and a feeder.

A paving train 10 for producing a surface covering or a road of rolled asphalt conventionally comprises at least one road paver 12 and at most one feeder 14. The road paver 12 serves to apply material supplied to it, such as, for example, asphalt, to a subsurface 38, to distribute it more or less evenly and to compact it in a suitable manner. At least one layer-forming asphalt roadway paving is thus created.

In order to move along the subsurface 38 which is to be provided with the road covering, the road paver 12 has an undercarriage 16, which is often designed as a tracked undercarriage with a drive, as in the present case. The road paver 12 has a so-called screed 18 at its rear end region. The material is supplied to this screed 18 in order to be evenly distributed and compacted on the subsurface 38. A distributing auger 20, not visible in detail here, is usually provided in the region of the screed 18 for at least coarse distribution. The undercarriage 16 of the road paver 12 stands on the subsurface 38 and not on the fresh road surface. When operating, in other words during the production of the road surface, it travels away from the edge of the road surface that has just been produced.

The road paver 12 has a hopper 22 for the material at a front end region. While the road paver 12 is operating, the material is successively removed from this hopper 22 and transported through the inner, in particular the lower, region of the road paver 12 near the ground into the region of the screed 18. A conveyor 24, in particular a scraper conveyor, is provided for this transporting. A drive unit 26, which here has an internal combustion engine, is provided to drive the components, in particular the undercarriage 16, the conveying devices etc of the road paver 12. The road paver 12 can be controlled, in particular by manual intervention, in the region of the operating platform 28 with operating elements 30. At least one seat 32 and one roof 34 for protection from the weather are provided for an operator.

The material is supplied to the hopper 22 by a feeder 14. For this purpose, the feeder 14 has a conveyor boom 40 with a conveyor 42 extending along it. The conveyor boom 40 is articulated at a rear end region of the feeder 14. A pivoting device 44 is provided for the height adjustment and lateral adjustment of the conveyor boom 40. The pivoting device 44 can be automatically controlled, in particular pivoted, by an operator. It can thus be ensured that the material transported with the aid of the conveyor 42 lands in the hopper 22 of the road paver 12 in every case. To this end, the conveyor boom 40 tracks the road paver 12 during the process in a suitable manner. This is necessary in particular when the road paver 12 and the feeder 14 are operating together. The direction of travel 36 of the road paver 12 or the entire paving train 10 including the feeder 14 during operation, in other words when a road covering is being produced, is in the direction of the arrow of direction of travel 36, in other words to the left in the plane of the drawing or plane of the sheet of paper in FIG. 1.

To move, the feeder 14 has an undercarriage 46 that is designed here as a tracked undercarriage. The feeder 14 has its own drive unit 48, typically with an internal combustion engine, as a drive for the undercarriage 46 and the different units of the feeder 14. An operating platform 50 with operating elements 52 is provided for controlling the feeder 14, in other words in particular the undercarriage 46, the conveyor 42 and the conveyor boom 40. At least one seat 54 and one roof 56 serve to improve the working conditions of the at least one operator and to protect the operating platform from the weather.

The feeder 14 has a hopper 58 at its front end region. A transport vehicle such as, for example, a lorry with, for example, a tippable loading area can pour a quantity of the material into this hopper 58. The material is preferably removed from the hopper 58 with the aid of a conveyor 60 such as, for example, a scraper conveyor. To this end, the conveyor 60 extends from the region of the hopper 58 as far as the region of the conveyor boom 40. The material is there reloaded onto a conveyor 42, for example by falling down onto it. The conveyor 42 then transports the material further along the conveyor boom 40. At its free end region with a tensioning roller 62, it then falls down from the conveyor 42. Because of the transporting speed of the conveyor 42 the material usually falls downwards and forwards, in the opposite direction to the direction of travel 36, forming a parabola or arc. The free end of the conveyor boom 40 must thus be arranged at such a distance from the hopper 22 in the direction of travel 36 of the paving train 10 that the material lands on the hopper 22 on the road paver. Alternatively, a continuous conveyor can also be provided instead of the two separate conveyors 42 and 60 so that there is no need for reloading.

The pivoting device 44 usually has a hydraulic design. It can adjust the horizontal and vertical orientation or position of the free end of the conveyor boom 40 relative to the feeder 14 and thus also relative to the road paver 12. A movable deflection member 80, such as a guide plate, is additionally provided here at the free end of the conveyor boom 40. This can in a simple manner move the stream of material laterally or forwards and backwards, depending on the arrangement of deflection member 80 transversely to or in the direction of travel 36 of the feeder 14. To do this, the deflection member 80 must be pivoted or adjusted slightly.

Figure 2:
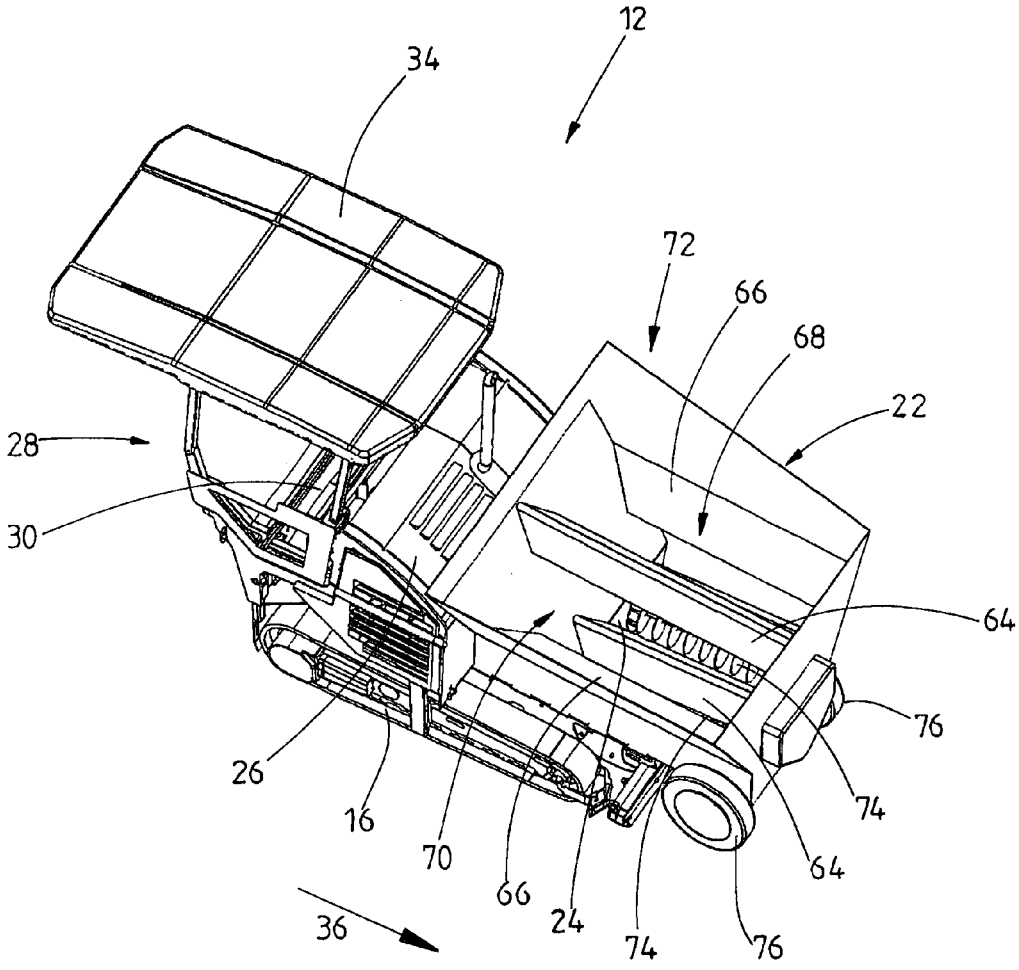
FIG. 2 shows a perspective view of a first embodiment of a road paver with a homogenizer.

The first embodiment of a road paver 12 according to the invention shown in detail in FIG. 2 is designed to be self-propelled and accordingly also has an undercarriage 16. A drive unit 26 with an internal combustion engine is provided to drive the undercarriage 16 and the other components. An operating platform 28 with a roof 34 provides protection from the weather. The operating platform 28 houses operating elements 30 for an operator to control the road paver 12.

The road paver 12 has a hopper 22 at its front end region. The hopper 22 serves, on the one hand, to hold the material or asphalt to be used as the road covering. On the other hand, the hopper 22 simultaneously serves to homogenize material by means of corresponding equipment, in other words serves as a homogenizer 72. Guide plates 64 and 66 are arranged inside the hopper 22 and serve to deflect the stream of material inside the hopper 22. They are particularly suited to partitioning the chamber 68, 70 of the hopper 22 at least roughly into a left and a right half. To this end, the guide plates 64 have a roof-like design, in particular in the middle region of the hopper 22. The laterally arranged guide plates 66 are designed as essentially plane sheets. They extend respectively along the entire length of the hopper 22. They run obliquely downwards from the side wall 104 of the hopper 22.

Moreover, in the lower region of the hopper 22, two conveying augers 74 are arranged here which serve predominantly to transport or convey the material from the hopper 22 onto the conveyor 24. At the same time, they at least partially serve to thoroughly mix the material. Because the conveying augers 74 can be controlled individually, differing amounts of the material can be transported from the left chamber 68 or the right chamber of the hopper 22 onto the conveyor 24 arranged beneath the operating-platform end of the conveying auger 74. The conveyor 24 serves to transport the material to the rear end of the road paver 12 in the region of the operating platform 28. The material is there applied to the subsurface by the screed 18.

The hopper 22 here has three wheels 76 for supporting it on a subsurface 38, so that the weight of the hopper 22 is not supported exclusively by the undercarriage 16 of the road paver 12.

The road paver 12 described here can be operated in an alternative embodiment also as a separate, in particular self-propelled homogenizer 72 or as a homogenizing system. For this, the screed 18 is removed at the rear end of the road paver 12 and replaced by a coupling and/or an additional conveyor, in order to transfer the material to, for example, a road paver 12 or feeder 14.

The hopper 22 of the road paver 12 can be exchanged for alternative embodiments of the hopper 22. In particular, the different embodiments in FIGS. 3 to 6 may be considered. The description of identical constituents or components of the different embodiments is thus in part not repeated.

Figure 3:
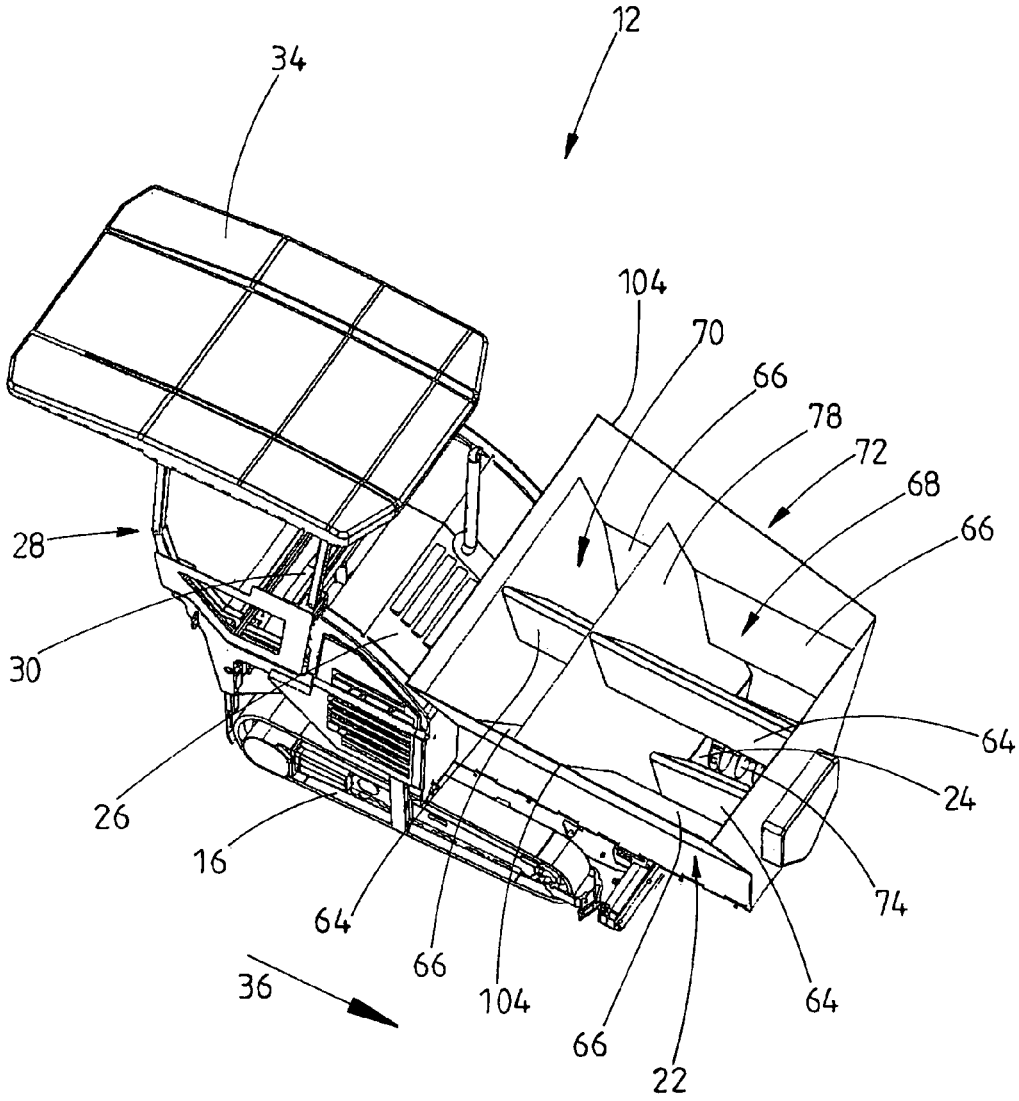
FIG. 3 shows a perspective view of a second embodiment of a road paver with a homogenizer.

FIG. 3 shows an alternative embodiment of a road paver 12 according to the invention. The road paver 12 shown here essentially corresponds to that described above as the first embodiment. Only the hopper 22 has been modified.

In the present case, two chambers 68 and 70 are arranged one behind the other inside the hopper 22, in the direction of travel 36 of the road paver 12. The chamber 68 is designed to be significantly larger than the chamber 70. Accordingly, the chamber 68 in the present case contains about four times more material as its volume is about four times as large. A partition wall 78, which is arranged transversely to the direction of travel, serves to divide the hopper 22 into the two chambers 68 and 70. Lateral guide plates 66 are arranged inside the two chambers 68 and 70, and roof-shaped guide plates 64 are arranged in the central region, to deflect the material. In an alternative embodiment, these guide plates 64 and 66 can, however, be omitted.

The larger chamber 68 serves to hold the material that is at the correct temperature. In the smaller chamber 70, on the other hand, the material to be homogenized or colder material is stored.

Figure 4:
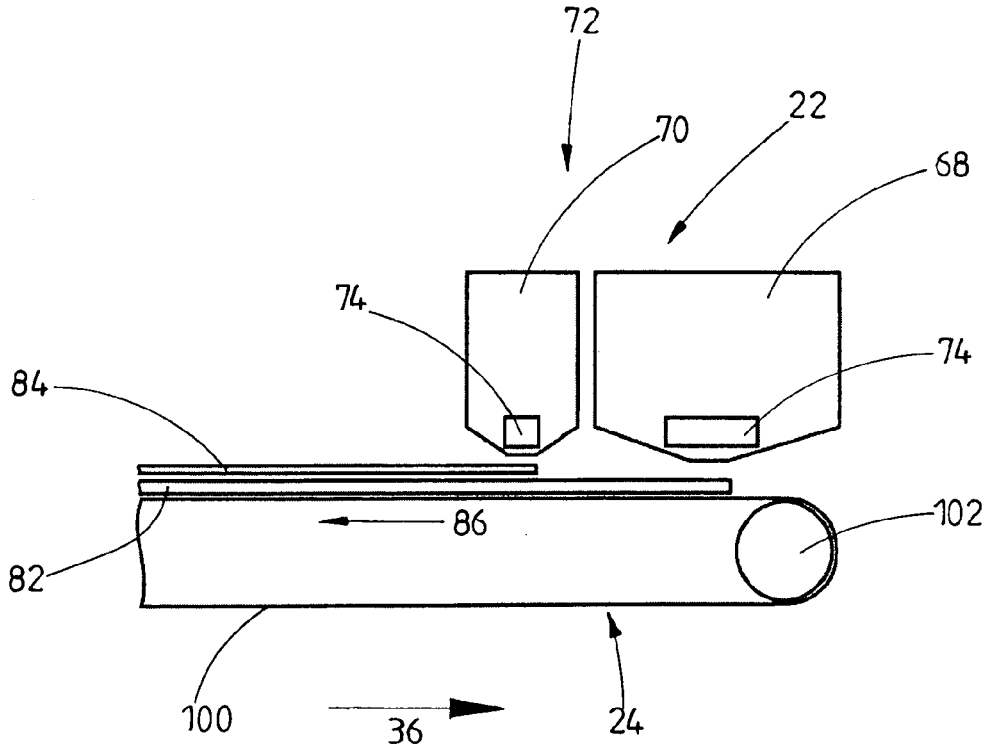
FIG. 4 shows a schematic diagram of the homogenizer in FIG. 3.
Figure 5:
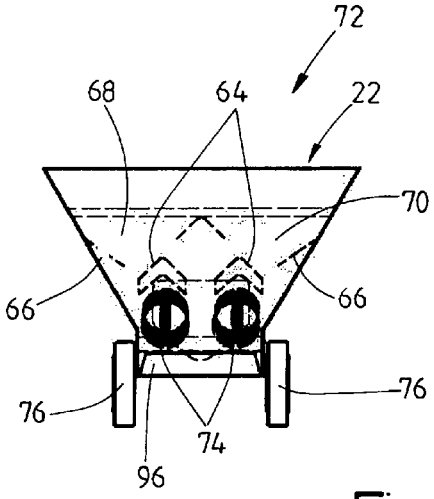
FIG. 5 shows a homogenizer according to the invention according to a third embodiment in a front view.
Figure 6:
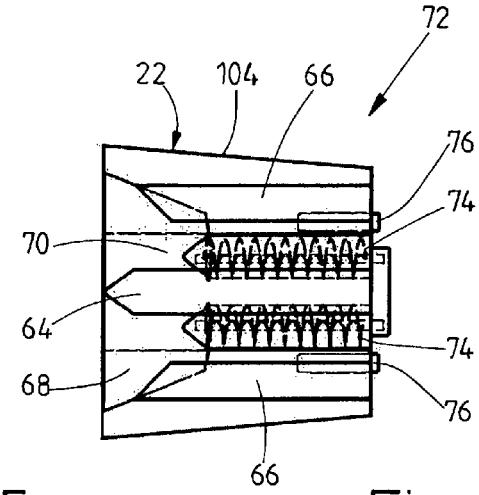
FIG. 6 shows a top view of the homogenizer according to FIG. 5.

The hopper 22 or homogenizer from FIG. 3 is shown in FIG. 4 with a portion of the conveyor 24 in a schematic diagram. The conveyor 24 has a scraper belt 100 that is guided around a tensioning roller 102. The upper section of the scraper belt 100 facing the chambers 68 and 70 moves to the left in the plane of the drawing and thus in the opposite direction to the direction of travel 36 of the road paver 12, in other words in a running direction 86.

It can be observed how the two chambers 68 and 70 are arranged relative to the conveyor 24. The material from the chamber 68 is deposited on the conveyor 24 with the aid of the conveying auger 74 as a first layer 82. An opening 96 is present for this purpose in the bottom of the hopper 22 or the chambers 68, 70. As long as there is also material in the chamber 70, it is added as a comparatively thin second layer 84 on top of the first layer 82. Accordingly, the chamber 70 is arranged behind the chamber 68, in the running direction 86 of the conveyor 24, in other words in the opposite direction to the direction of travel 36. It is hereby ensured that the material from the chamber 70 can be added to the material from the chamber 68. Because only a relatively thin layer 84 of the colder material from the chamber 70 is used in comparison with the layer 82, the temperature of the colder material can be matched to that of the warmer material. All in all, a homogenization of the temperature is achieved that approaches the optimum surfacing temperature.

The upper layer 84 can but does not have to be applied as a continuous layer on top of the lower layer 82. In particular, if the chamber 70 is empty or also for a better distribution of the material, an interrupted addition, or addition in sections, of the colder material can also take place. The layer 84 is then not formed as a continuous layer as shown in FIG. 4 but has interruptions. As a distributing auger 20 is arranged in the region of the screed 18, a corresponding mixture is nevertheless ensured. Additionally, however, another mixing system and/or an additional mixing device can be arranged at the end of the conveyor 24, which effects an additional thorough mixing. The conveying augers 74 at the same time serve as mixing and conveying augers. Viewed from above, they are arranged parallel to each other.

Figure 7:
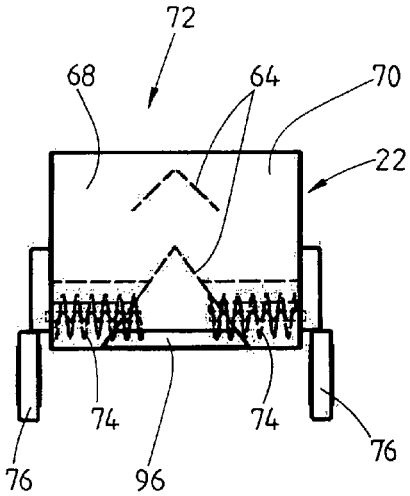
FIG. 7 shows a homogenizer according to the invention according to a fourth embodiment in a front view.
Figure 8:
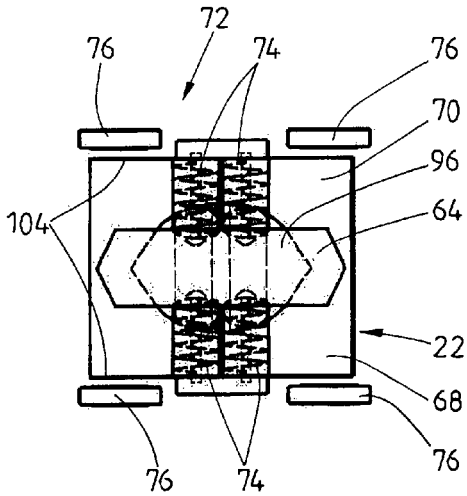
FIG. 8 shows a top view of the homogenizer according to FIG. 7.

In the embodiment in FIGS. 7 and 8, the homogenizer 72 has four conveying augers 74 which are arranged transversely to the direction of travel or to the mounting direction. The conveying augers 74 in each pair are arranged parallel to each other. They serve to supply the material, in particular in counterrotating fashion, for the purpose of thorough mixing. Because chambers 68 and 70 on either side of the hopper 22 are divided by the guide plates 64, materials at different temperatures can be poured into the two chambers 68 and 70. By controlling the conveying augers 74 beneath the respective chambers 68 and 70, the material contained in each case can be conveyed in a metered fashion into the region of the conveyor 24 arranged beneath the hopper 22. When, for example, one chamber 68 contains the material at the right temperature, this material can be supplied to the conveyor 24 as a base material or lower layer 82. A metered supply of comparatively small amounts of the colder material from the chamber 70 as a second layer 84 results in an only slight cooling of the base material and a sufficient heating up of the added material from the chamber 70. All in all, a suitable temperature of the material for producing a roadway paving is thus ensured.

Figure 9:
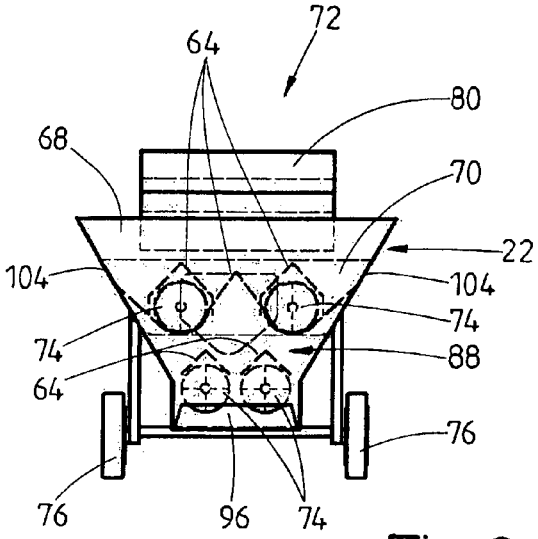
FIG. 9 shows a homogenizer according to the invention according to a fifth embodiment in a front view.
Figure 10:
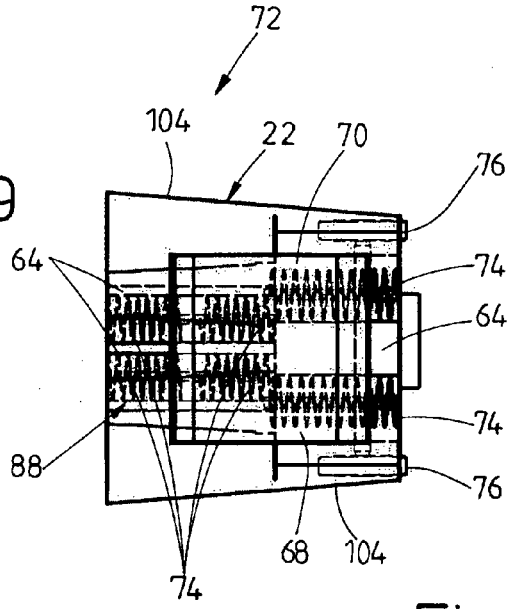
FIG. 10 shows a top view of the homogenizer according to FIG. 9.
Figure 11:
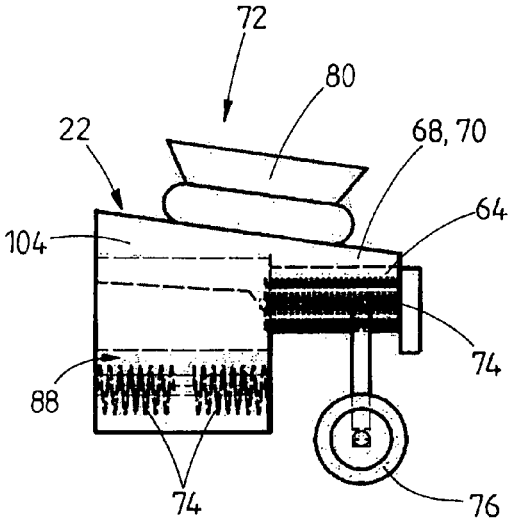
FIG. 11 shows a side view of the homogenizer according to FIG. 9.

A further alternative embodiment is shown in FIGS. 9 to 11. Here the two chambers 68 and 70 are arranged next to each other in the direction of travel above the wheels 76. A mixing chamber 88 is situated behind. Two conveying augers 74 for metering the addition of material into the mixing chamber 88 are arranged in the region of the chambers 68 and 70. A total of four conveying augers 74, which serve to convey or mix the material, are arranged in the lower region of the mixing chamber 88. A deflecting flap or a deflecting member 80, or alternatively a conveyor belt, is arranged above the chambers 68 and 70. The deflecting flap 80 or the conveyor belt serve to guide the material laterally into the different chambers 68 and 70. The chamber 68 contains the warmer material at the right temperature, and the chamber 70 contains the colder material.

Figure 12:
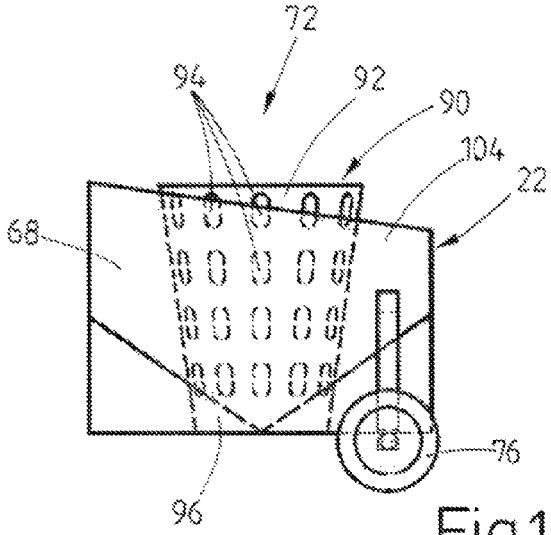
FIG. 12 shows a homogenizer according to the invention according to a sixth embodiment in a front view.
Figure 13:
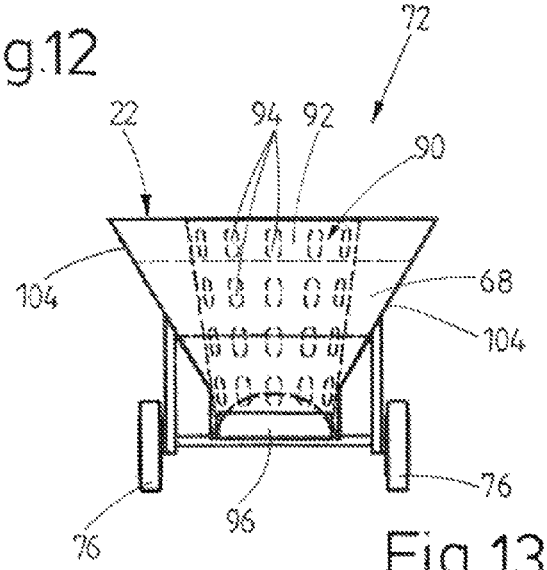
FIG. 13 shows a front view of the homogenizer according to FIG. 12.
Figure 14:
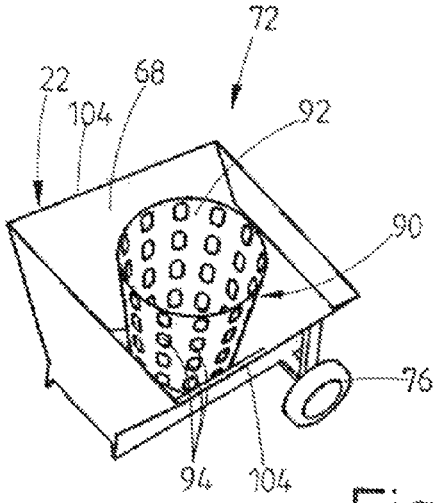
FIG. 14 shows a perspective view of the homogenizer according to FIG. 12.

The embodiment in FIGS. 12 to 14 shows a hopper 22 in which a bucket 90 is arranged. This bucket 90 overall has a conical shape with a circular cross section. It is arranged with its feeding end pointing downwards. A plurality of holes 94 are arranged in the side wall 92 of the bucket 90. The opening 96 in the bottom here also serves to discharge material onto the conveyor 24.

The homogenizer 72 of this embodiment that is shown functions as follows: the material at the correct temperature is poured into the inside of the bucket 90. The material that is too cold or which is separated is added into the hopper 22 beneath the bucket 90. While material is discharged through the opening 96 in the bottom onto the conveyor 24, the filling level inside the hopper 22 or in the chamber 68 falls so that a growing number of holes 94 are present above the material. As soon as material outside the bucket 90 has a higher filling level, this material flows laterally through the holes 94 into the bucket 90 and onto the warmer material situated therein. However, this happens only in metered proportions as the amount of the material flowing in is determined by the filling level in the bucket 90. As soon as more warmer material is added, its filling level may exceed the filling level outside the bucket 90 so that cold material can no longer flow into the inside of the bucket 90. Moreover, not only is the cold material in the bucket 90 covered with new material, but also material from the inside of the bucket 90 flows out through the holes 104. All in all, this results in a thorough mixing of warm and cold material.

The process according to the invention functions as follows:

The temperature of the material supplied from the feeder 14 is determined. To do this, for example a measuring apparatus 98 is provided, such as at least one heat sensor or infrared sensor or even an infrared camera. In order to scan the entire stream of material simply, the measuring apparatus 98 is arranged above the conveyor 42 on the feeder 14. It is also possible to provide a plurality, at least two, but preferably three measuring apparatus 98 and/or a measuring apparatus 98 having at least two, but preferably three sensors. The sensors or measuring apparatus 98 are preferably distributed in linear fashion along the conveying path of the conveyor boom 40.

As soon as it is established that at least part of the material or the stream of material has material that is too cold, the corresponding part of the material is separated, for example with the aid of a deflecting member 80 or with the aid of a guide plate. This part of the material to be homogenized is thereby guided away into the separate chamber 70.

The other material, which is at the correct temperature, passes into the chamber 68. Material is removed from these two chambers 68 and 70 in order to be supplied to the road paver 12 or the screed 18 to produce an asphalt layer. In this way, the colder material from the chamber 70 is supplied to the material at the correct temperature from the chamber 68 only in the proportion that causes no excessive cooling of the material at the correct temperature and, on the other hand, that the material which is too cold is heated up sufficiently.

As so-called "nests" of cold material, which are usually only local, are present in the stream of material, for example on the conveyor 24 of the road paver 12 or also on the conveyor 42 of the feeder 14, a suitable spatial resolution of the measuring apparatus 98 must be provided. The resolution should be provided such that, on the one hand, the nests are recognized and, on the other hand, no colder areas are ignored, creating no problems. This is, for example, ensured by three sensors or also an infrared camera system.

The measuring apparatus 98 for determining the temperature can be provided, for example, on the feeder 14. Alternatively, the arrangement can also, however, be situated in the region of the road paver 12. The device for homogenizing the material, in other words in particular the homogenizer 72, can be substituted for the hopper 22 of the road paver 12. Alternatively, a separate, in particular self-propelled homogenizer can also be used. It is also possible to substitute the hopper 22 on the feeder 14 for a corresponding device for homogenizing. The apparatus for measuring the temperature must accordingly be arranged in front of the corresponding device for separating the material.

Figure 15:
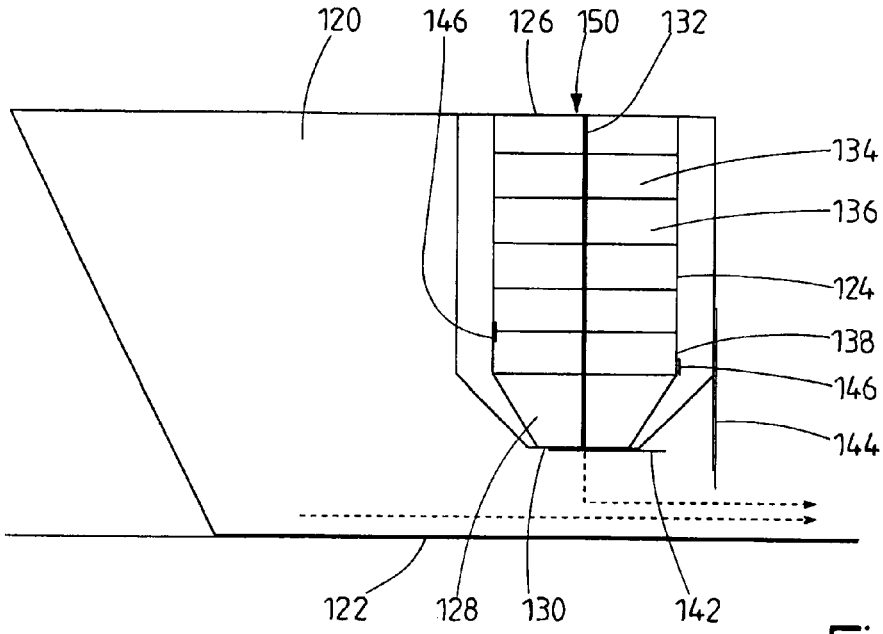
FIG. 15 shows a mixing container with a mixing device.
Figure 16:
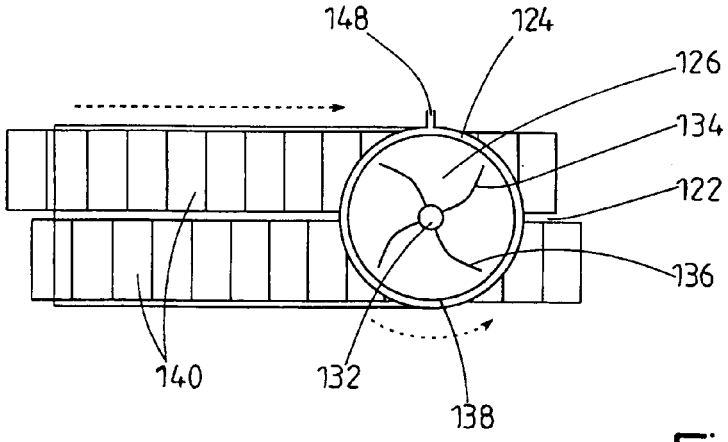
FIG. 16 shows a conveyor with two slatted frames.

In the following, a further exemplary embodiment of the invention will be described with reference to FIGS. 15 and 16:

As in the previous exemplary embodiment, the hopper 120 serves to accommodate the mix which has the correct temperature. Shown in FIG. 16 is the conveyor 122 with the two slatted frames 140. An additional mixing container 124 is arranged downstream with respect to the conveyor 122, i.e. in the direction of the screed (not shown) to the right. This mixing container 124 has a (horizontal) cross-section which is circular in shape. Correspondingly, it assumes an essentially cylindrical configuration. In this arrangement, the mixing container 124 assumes an upright or vertical alignment. Located at its top end is a circular filling opening 126, which has essentially the same cross-section as the mixing container 124. Located at the lower end is a conically tapering region 128, at the bottom of which a discharge opening 130 is provided. The discharge opening 130 is located above the conveyor 122 and thus above the material flow of the mixture as it is conveyed by the conveyor 122 out of the hopper 120. Accordingly, the mixture discharged from the mixing container 124 is added to the other mixture on the conveyor 122.

The mixing container 124 has a mixing device 150 with a central rotational axis 132, about which a plurality of wings or blades 134, 136 is arranged. In this arrangement the blades 134, 136 extend essentially from the rotational axis 132 almost to an inner wall 138 of the mixing container 124. In the present case, the blades 134, 136 are configured as alternating concave blades 134 and convex blades 136. When the mixing device 150 revolves about its rotational axis 132, this ensures that the mixture located between the blades 134 and 136 is moved alternately along the path of the mixture from the upper filling opening 126 to the lower discharge opening 130 and from the inner wall 138 toward the rotational axis 132 and vice versa. This ensures that the mixture is moved in an essentially oscillating manner and is thus blended quite effectively.

In order for asphalt too cold for incorporation into an asphalt layer to be brought to the correct temperature, the mixing container 124 has a heating element (not shown). In this arrangement, the blades 134 and 136 can be heated by an electric or gas powered heating element. Alternatively, or as a supplement, the inner wall 138 of the mixing container 124 can also be heated. Provided in the outer wall of the mixing container 124 is a flue 148. In case a gas heater is employed, the flue 148 serves as an channel for discharging combustion gases or as a general discharge conduit for gases escaping from the mixture.

In order to determine the temperature or temperature distribution of the mixture in the mixing container 124, a plurality of temperature sensors 146 are disposed at least in the lower region of the mixing container 124 at different heights or even arranged one above the another in a vertical alignment. Here the temperature sensors 146 are positioned on opposing sides of the mixing container 124 at different heights. Accordingly, as soon as the temperature lies within a predetermined range or matches the temperature of the mixture in the main hopper 120 within the tolerance limits, the discharge opening 130 at the lower end of the mixing container 124 can be opened to discharge at least part of the homogenized mixture. Provided for this is a sliding or revolving closure 142.

In order to provide an additional means for regulating the overall flow of material, a further closure 144 is arranged above the conveyor 122 for adjusting the total volume of the mixture discharged on the conveyor.

The foregoing detailed description of the preferred embodiments and the appended figures have been presented only for illustrative and descriptive purposes. They are not intended to be exhaustive and are not intended to limit the scope and spirit of the invention. The embodiments were selected and described to best explain the principles of the invention and its practical applications. One skilled in the art will recognize that many variations can be made to the invention disclosed in this specification without departing from the scope and spirit of the invention.

LIST OF DESIGNATIONS

10 paving train
12 road paver
14 feeder
16 undercarriage
18 screed
20 distributing auger
22 hopper
24 conveyor
26 drive unit
28 operating platform
30 operating elements
32 seat
34 roof
36 direction of travel
38 subsurface
40 conveying boom
42 conveyor
44 pivoting device
46 undercarriage
48 drive unit
50 operating platform
52 operating elements
54 seat
56 roof
58 hopper
60 conveyor
62 tensioning roller
64 guide plate
66 guide plate
68 chamber
70 chamber
72 homogenizer
74 conveying auger
76 wheel
78 partition wall
80 deflecting member
82 layer
84 layer
86 running direction
88 mixing chamber
90 bucket
92 side wall
94 hole
96 opening
98 measuring apparatus
100 scraper belt
102 tensioning roller
104 side wall
120 hopper
122 conveyor
124 mixing container
126 filling opening
128 conically tapering region
130 discharge opening
132 rotational axis
134 blade
136 blade
138 inner wall
140 slatted frame
142 closure
144 closure
146 temperature sensor
148 flue
150 mixing device

What is claimed is:

1. A process for producing a road covering of asphalt, namely an asphalt surface or an asphalt road, with a road paver (12), comprising:

supplying the road paver (12) with material for producing the road covering, said material for producing the road covering, said material being homogenized, wherein specifically only said material being homogenized deviates in temperature from predetermined requirements for the road covering; and separating said material being homogenized from other material for producing the road covering at least temporarily, wherein the other material has at least the predetermined requirements.

2. The process according to claim 1, further comprising supplying the other material to a chamber (68) of a hopper (22).

3. The process according to claim 2, further comprising supplying the material being homogenized to a separate chamber in a separate hopper (22).

4. The process according to claim 3, further comprising supplying the material being homogenized from the separate hopper to the other material, in metered fashion or in layers, the material being homogenized being removed from the separate hopper by a conveyor.

5. The process according to claim 1, further comprising thoroughly mixing the material being homogenized and/or the other material with each other, with a mixing device having at least one conveyor having a conveying auger (74).

6. The process according to claim 1, further comprising feeding a portion of the material being homogenized to a separate, heat-insulated, cylindrically-shaped mixing container (124), and blending and/or heating the material being homogenized in the container to a homogenous temperature.

7. The process according to claim 6, further comprising determining the temperature of the material being homogenized by means of a plurality of temperature sensors (146) disposed in the region of a wall and/or of a bottom of the container holding the material being homogenized.

8. The process according to claim 6, further comprising emptying the container holding the material being homogenized via at least one discharge opening.

9. The process according to claim 1, further comprising homogenizing said material for producing the road covering at least partly in respect of its temperature, with material being homogenized that deviates from a reference temperature or an average temperature being distributed more evenly or more finely relative to aid other material whereby the temperature of said material being homogenized is matched to the temperature of said other material.

10. The process according to claim 1, wherein said material being homogenized has an average deviation, and/or a negative deviation at least in sections, from a reference temperature or from an average temperature of said other material.

11. The process according to claim 10, wherein 120° C. is predetermined as the reference temperature, and wherein the temperature for the minimum threshold of a deviation is selected from the group consisting of 5 K, 10 K, 14 K, and 20 K.

12. The process according to claim 9, wherein the temperature of said material for producing the road covering is determined at least in areas by means of at least one measuring apparatus (98) or sensor arrangement, at least essentially continuously.

13. The process according to claim 12, wherein the temperature of said material for producing the road covering is measured in the region of the road paver (12) and/or of a feeder (14), in the region of a conveyor (42) for supplying said material for producing the road covering and/or in the region of a hopper (22) or a chamber (68, 70) for said material for producing the road covering.

14. The process according the claim 12, wherein at least one measuring apparatus (98) associated with the road paver (12) or with the feeder (14) and having at least one sensor that works in a non-contact fashion is used to measure the temperature of said material for producing the road covering.

* * * * *